United States Patent [19]

Yamamoto et al.

[11] Patent Number: 4,663,986

[45] Date of Patent: May 12, 1987

[54] DEVICE FOR DRIVING MULTI-DRUM COILER OR UN-COILER

[75] Inventors: Michinori Yamamoto; Shozo Tashiro, both of Hiroshima, Japan

[73] Assignee: Mitsubishi Jukogyo Kabushiki Kaisha, Tokyo, Japan

[21] Appl. No.: 623,764

[22] Filed: Jun. 20, 1984

[51] Int. Cl.[4] ..... F16H 37/06

[52] U.S. Cl. ..... 74/665 N; 74/750 R; 242/78.1

[58] Field of Search ..... 74/665 L, 665 N, 665 Q, 74/803, 750 R; 242/67.1 R, 78.1, 78.3, 80

[56] References Cited

U.S. PATENT DOCUMENTS

| | | | |
|---|---|---|---|
| 1,123,396 | 1/1915 | Schoonmaker | 74/750 R |
| 1,695,214 | 12/1928 | Sorensen | 74/750 R |
| 2,182,285 | 12/1939 | De Caria | 74/750 R |
| 3,056,314 | 10/1962 | Eichler et al. | 74/665 N X |
| 4,351,635 | 9/1982 | Staedeli | 74/665 N X |

FOREIGN PATENT DOCUMENTS

| | | | |
|---|---|---|---|
| 42962 | 9/1930 | Denmark | 74/665 N |
| 59-19026 | 1/1984 | Japan | 242/78.1 |

*Primary Examiner*—Leslie Braun
*Assistant Examiner*—Dwight G. Diehl
*Attorney, Agent, or Firm*—Wenderoth, Lind & Ponack

[57] ABSTRACT

A device for driving two winding drum shafts which are rotatably supported by the body of a coiler or un-coiler that acts to wind or unwind rolled material. A casing constituting a ring gear frame is disposed at the center of the body, which is revolved in a circle. Two ring gears each of which has external teeth and internal teeth are rotatably held to the casing. Two pinions mate with the internal teeth of these two ring gears. Two motors are provided to drive their respective drum shafts. When rotatory motion produced by each of these motors is transmitted to the drum shafts via the ring gear mechanisms, the mating engagement of the pinions with the ring gears results in a high reduction gear ratio. Another motor is also provided to revolve the body of the machine in a circle.

3 Claims, 3 Drawing Figures

DEVICE FOR DRIVING MULTI-DRUM COILER OR UN-COILER

FIELD OF THE INVENTION

The present invention relates to a device for driving a coiler or un-coiler having a plurality of drums.

BACKGROUND OF THE INVENTION

Multi-drum coilers and un-coilers have been proposed heretofore to ensure continuity of operation, i.e., to shorten the idle time, in winding or unwinding rolled materials in a rolling mill. The body of such a conventional device has a plurality of winding drum shafts and is rotatably supported. The body is revolved in a circle while one of the drum shafts is being driven for winding or unwinding, in order to exchange the drum shaft in one specific position for another. One example of this kind of device is shown in FIG. 1, where the body 2 of the machine has two winding drum shafts 1*a* and 1*b* which are rotated to directly wind or unwind rolled material and which are supported in a symmetrical relation with respect to the central axis of the body. The end of the body 2 from which the winding drum shafts project is supported by rollers (not shown) placed on the foundation of the machine, while the opposite end is supported by a bearing 5 incorporated in the casing 4 of a gearing 3 placed on the front side, so that the body is rotatable. The drum shaft 1*a* is connected to an electric motor 11*a* for driving the shaft via a toothed wheel 6*a* integral with the shaft 1*a*, a solid, intermediate shaft 7*a*, a toothed wheel 8*a* on the shaft 7*a* mating with the wheel 6*a*, a toothed wheel 9*a* on the shaft 7*a* and in the gearing 3, and a toothed wheel 10*a* mating with the wheel 9*a*. The shaft 7*a* is rotatably mounted in the body 2 and to the casing 4. The other drum shaft 1*b* is connected to another electric motor 11*b* for driving it via a toothed wheel 6*b* integral with the shaft 1*b*, a toothed wheel 8*b* mating with the wheel 6*b* on which the hollow, intermediate shaft 7*b*, a toothed wheel 8*b* is mounted, a toothed wheel 9*b* on shaft 7*b* and in the gearing 3, and a toothed wheel 10*b* mating with the wheel 9*b*. The shaft 7*b* is rotatably mounted in the body 2. The outer periphery of the body 2 is provided with teeth 12 with which a toothed wheel (not shown) coupled to an electric motor (not shown) is engaged for revolving the body in a circle mate. Thus, when this motor is operated, the body 2 of the machine is rotated. The drum shaft 1*a* is driven by the motor 11*a* via the wheels 10*a* and 9*a*, the intermediate shaft 7*a*, and the wheels 8*a* and 6*a*. Similarly, the drum shaft 1*b* is driven by the motor 11*b* via the wheels 10*b* and 9*b*, the intermediate shaft 7*b*, and the wheels 8*b* and 6*b*.

In the driving system of the winding drum shafts 1*a* and 1*b* of the above multi-drum coiler or un-coiler, the two sets of toothed wheels, i.e., 6*a*, 8*a* and 6*b* and 8*b*, are disposed in parallel relation to each other, as described previously, and hence it is impossible to obtain a high reduction ratio. Therefore, it is necessary to achieve the desired reduction ratio by means of the gears within the gearing 3, thus usually making the gearing 3 bulky. Further, since the hollow, intermediate shafts 7*a ; and* 7*b* are disposed coaxially, the gearing 3 on the front side is needed independently of the reduction ratio. This coaxial arrangement also makes it difficult to mount, disassemble, check, and maintain the intermediate shafts 7*a* and 7*b*. In addition, since the shafts 7*a* and 7*b* are arranged to occupy a considerable length, they are difficult to machine. Particularly, the intermediate shaft 7*b* is difficult to machine, thus requiring a sophisticated machining technique.

SUMMARY OF THE INVENTION

It is the main object of the present invention to provide a multi-drum coiler or un-coiler driving device which is free of the foregoing difficulties with the prior art device.

It is a more specific object of the invention to provide a multi-drum coiler or un-coiler driving device which can yield a higher reduction gear ratio than a driving device provided with the conventional parallel sets of gears and which can be made small and compact.

It is another object of the invention to provide a multi-drum coiler or un-coiler driving device which is easier to assemble, disassemble, check, and maintain than the conventional device having a solid shaft and a hollow shaft arranged coaxially, and which does not have any hollow shaft to be machined.

These objects are achieved in accordance with the present invention by providing a multi-drum coiler or un-coiler driving device in which the body of the device rotatably supporting a plurality of winding drum shafts is supported so as to be revolved, allowing the drum shafts to be revolved in a circle, and in which a plurality of ring gear mechanisms are linked to the respective drum shafts and are coupled to the respective driving source.

Other objects and features of the invention will appear in the course of description thereof which follows.

DETAILED DESCRIPTION OF THE INVENTION

Figure 1:
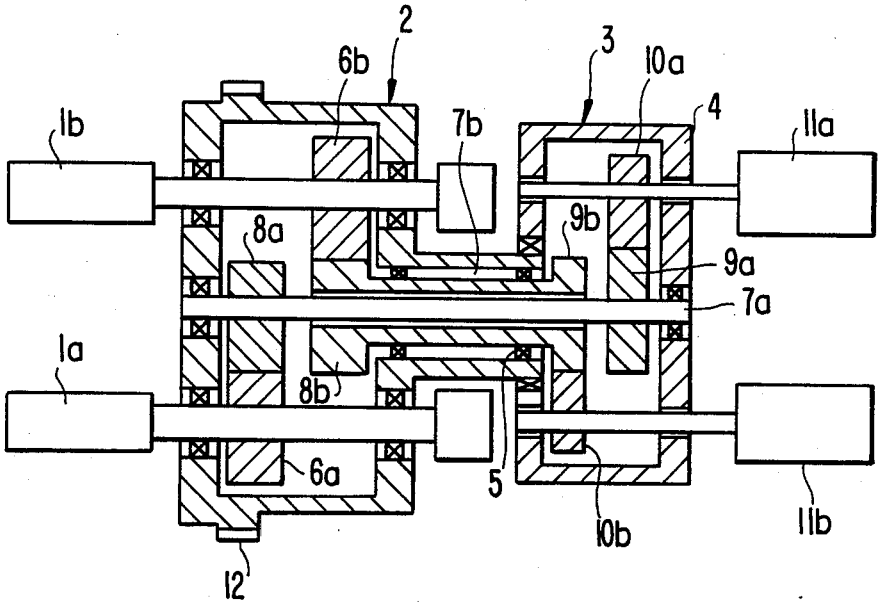
FIG. 1. (PRIOR ART)
FIG. 1 is a horizontal sectional view of a coiler or un-coiler equipped with a conventional driving device.
Figure 2:
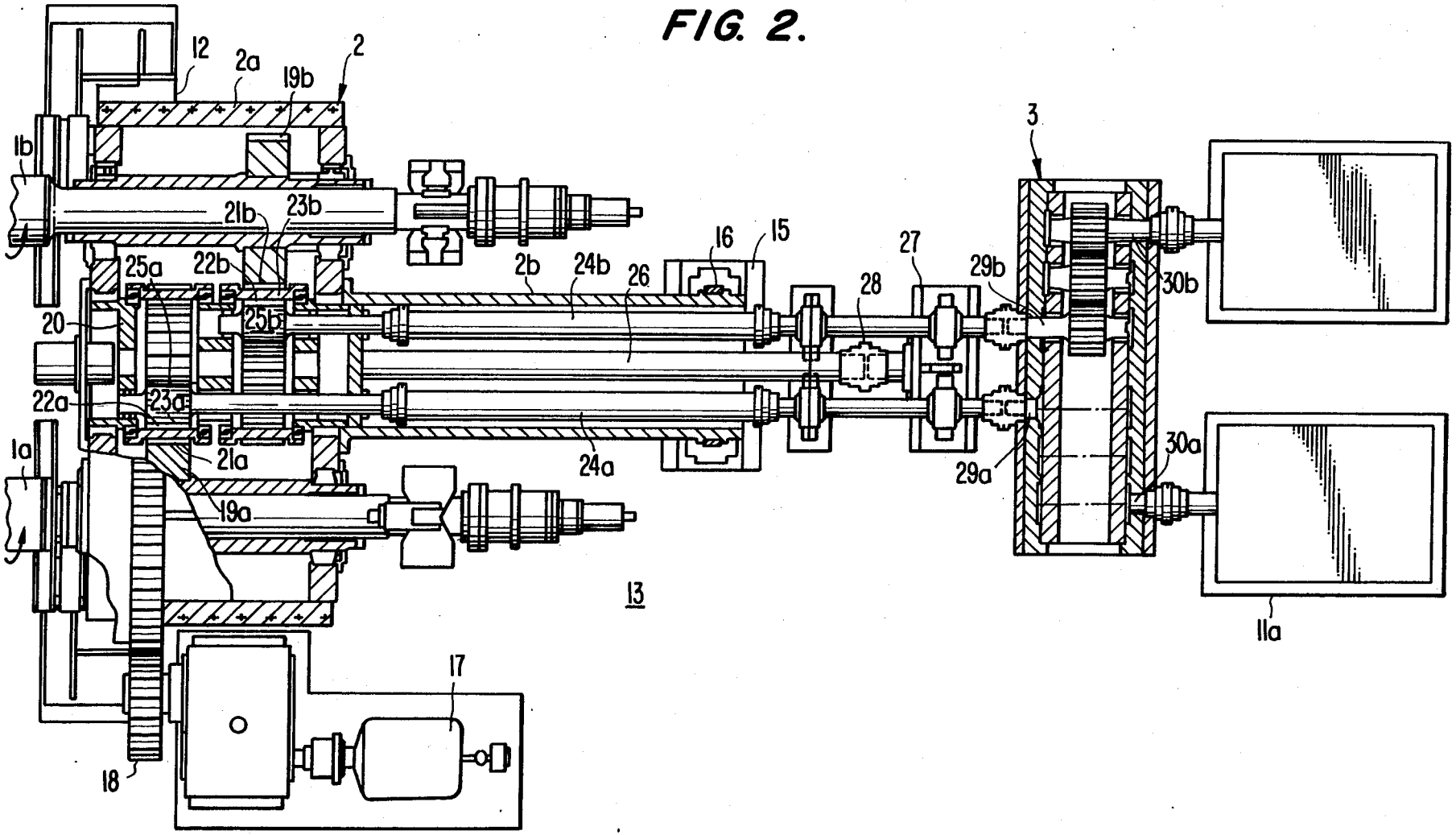
FIG. 2 is a plan view partially in section of a coiler or un-coiler equipped with a driving device according to the present invention.
Figure 3:
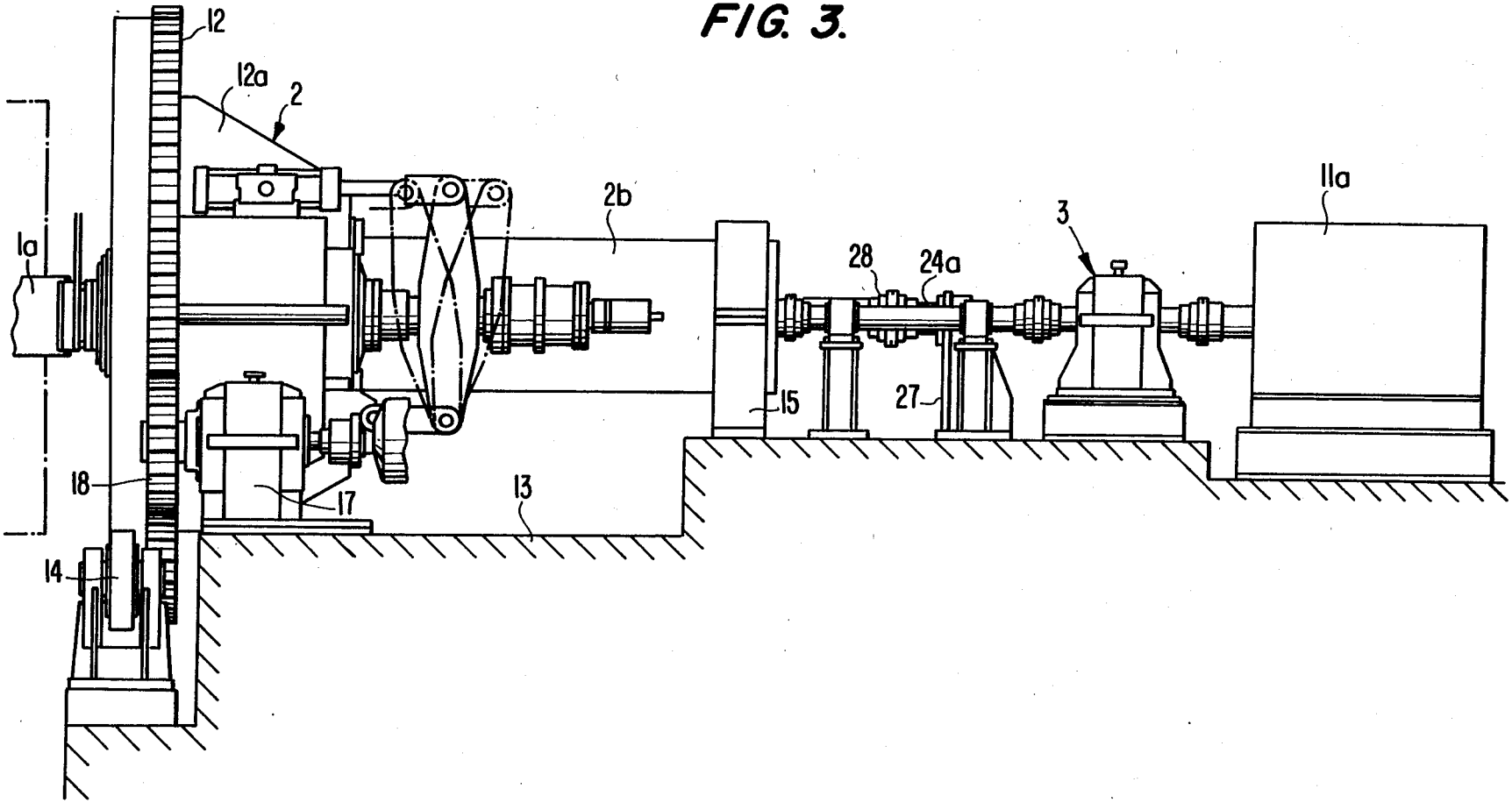
FIG. 3 is a side elevation of the coiler or un-coiler shown in FIG. 2.

Referring now to FIGS. 2 and 3, there is shown a driving device embodying the concept of the present invention. It is to be noted that in these figures the same components as those shown in FIG. 1 are indicated by the same reference numerals as in the previous figure. The body 2 of a coiler or un-coiler consists of a body portion 2*a* and a cylindrical portion 2*b* integral with the portion 2*a*. In the body portion 2*a*, winding drum shafts 1*a* and 1*b* are supported in symmetrical relation with respect to the center line of the body portion 2*a*. The end of the body 2 and hence of the body portion 2*a* which lies toward the drum shafts is supported by a plurality of rollers 14 placed on the foundation 13 of the machine. The other end of the body 2 and hence of the cylindrical portion 2*b* is supported by a bearing 16 which is mounted on a support base 15 such that its vertical position is adjustable, the base 15 being mounted on the foundation 13. In this illustrative example, the bearing 16 is in the form of a spherical bearing. Thus, the body 2 of the machine is constructed to be rotatable. The outer periphery of the body 2 is provided with teeth 12 with which a toothed wheel 18 engages, the wheel 18 being connected to an electric motor 17 for revolving the body 2 in a circle. As such, the body 2 is revolved by operating the motor 17.

The driving system of the two winding drum shafts 1*a* and 1*b* is constructed as follows. Toothed wheels 19*a* and 19*b* are mounted integral with the shanks of the shafts 1*a* and 1*b*, respectively, in the body 2. A casing 20 constituting a ring gear frame is rotatably supported by metal members at the center of the inside of the body 2. Ring gears 23*a* and 23*b* having external teeth 21*a* and internal teeth 22*a* and external teeth 21*b* and internal teeth 22*b*, respectively, are rotatably mounted on the casing 20 in such a way that the external teeth 21*a* and 21*b* mate with the wheels 19*a* and 19*b*, respectively. Two solid, intermediate driving shafts 24*a* and 24*b* extend from the cylindrical portion 2*b* of the body 2 into the body portion 2*a*. The ends of these shafts in the body portion 2*a* are rotatably mounted in the casing 20. Pinions 25*a* and 25*b* mating with the internal teeth 22*a* and 22*b* of the ring gears 23*a* and 23*b* are mounted integrally on these ends.

A coupling shaft 26 having flexibility extends through the center of the cylindrical portion 2*b* and has one end connected to the casing 20. The other end of the shaft 26 is connected to a support plate 27, which is mounted on the foundation 13, via a flexible coupling 28 such as a gear coupling. The shaft 26 prevents the casing 20 from rotating by receiving the circumferential and rotational repulsive force that acts on the casing 20. The intermediate driving shafts 24*a* and 24*b* are connected to the output shafts 29*a* and 29*b*, respectively, of a gearing 3 which is mounted on the opposite side of the body 2 from the winding shafts and on the foundation 13. The input shafts 30*a* and 30*b* of the gearing 3 are coupled to electric motors 11*a* and 11*b*, respectively, for driving their respective winding drum shafts, so that the driving force is transmitted to the output shafts 29*a* and 29*b* via the gear mechanism in the gearing 3.

In the operation of the novel device described above, the rotational driving force generated by the motor 11*a* is transmitted to the pinion 25*a* via the gearing 3 and the intermediate driving shaft 24*a*. The pinion 25*a* mates with the internal teeth 22*a* of the ring gear 23*a*. Therefore, the rotatory motion of the pinion 25*a* is transmitted to the ring gear 23*a* while producing a reduction in velocity. This decelerated motion is then transmitted to the drum shaft 1*a* via the external teeth 21*a* of the ring gear 23*a* and the toothed wheel 19*a* that is mounted on the shank of the shaft 1*a*. In this case, the pinion 25*a* turns only on its own axis without describing a circle. Also, the ring gear 23*a* turns only on the casing 20 which is now at rest. The winding drum shaft 1*b* is driven in the same manner.

As previously described, it is necessary for the multi-drum coiler or un-coiler to provide a revolution of the drum shaft 1*a* or 1*b* in a circle in addition to the rotation on its own axis. When the body 2 of the machine is revolved by operation of the revolution motor 17 through the mating engagement of the toothed wheel 18 with the toothed wheel 12, the toothed wheel 19*a* and 19*b* revolve around the external teeths 21*a* and 21*b* of the ring gears 23*a* and 23*b*, respectively, in mesh while turning on their own axes. At this time, the casing 20 surrounding the pinions 25*a* and 25*b* is at rest and is carried on metal members of the body 2 in an unrestricted way while supporting the ring gears 23*a* and 23*b*. During this revolution, the body 2 of the machine rotates relative to the casing 20 constituting the frame for the gear ring, thereby tending to cause a rotational repulsive force to be exerted on the casing 20. This rotational repulsive force may cause the external teeth 21*a* and 21*b* of the ring gears 23*a* and 23*b* to make non-uniform engagement with the wheels 19*a* and 19*b* of the drum shafts 1*a* and 1*b*, and also may cause the casing 20 to make non-uniform engagement with the metal members of the body 2 that support the casing 20. In order to prevent such an undesirable phenomena, the casing 20 should be able to freely move in the three orthogonal directions. In the present embodiment, this is achieved by providing the coupling shaft 26 and the flexible coupling 28 on the center line of the casing 20 so as to absorb the above-mentioned rotational repulsive force exerted on the casing 20.

As described in detail hereinbefore, the novel device for driving a multi-drum coiler or un-coiler has the plural winding drum shafts supported in the body of the machine. The plurality of ring gear mechanisms linked to the winding drums are also mounted in the body of the machine and are coupled to their respective driving sources. Consequently, the novel device is capable of producing a higher reduction gear ratio than a driving device making use of the conventional parallel sets of gears, and it can be made small and compact. The higher reduction ratio permits a decrease in the reduction ratio of the gearing disposed on the front side of the machine, thus allowing simplification and miniaturization of the structure. Further, the plural driving shafts connected to the body can be disposed side by side in spaced relation to each other on the same plane, and therefore it is easier to assemble, disassemble, check, and maintain than the prior art device having a coaxial arrangement of solid shaft and hollow shaft. Furthermore, the novel device does not require that hollow shafts be machined.

While a preferred embodiment of the invention has been described using specific terms, such description is for illustrative purposes only, and it is to be understood that various changes and variations may be made without departing from the spirit and scope of the following claims.

What is claimed is:

1. A device for driving a multi-drum coiler or un-coiler comprising:

a plurality of at least two winding drum shafts;

a body having a longitudinal central axis and rotatably supported for rotation around said longitudinal central axis, said winding drum shafts being rotatably mounted on said body parallel to and spaced from the longitudinal central axis and rotatable around the longitudinal axes of said shafts, said shafts being movable around said longitudinal central axis during rotation of said body;

a plurality of ring gear mechanisms rotatably mounted in said body for rotation around said longitudinal central axis and each having the outer periphery connected with a corresponding one of said winding shafts for driving said winding shafts when rotated;

a plurality of driving sources, one for each ring gear mechanism; and a plurality of pinion gear means connected with the inner periphery of corresponding ones of said ring gear mechanisms and rotatingly drivingly connected to corresponding ones of said driving sources.

2. A device as claimed in claim 1 further comprising a casing mounted within said body coaxial with said longitudinal central axis and on which said body is rotatably mounted, and said ring gear mechanisms being rotatably mounted on said body.

3. A device as claimed in claim 2 further comprising a flexible coupling shaft lying along said longitudinal central axis and a flexible coupling on one end of said flexible coupling shaft, the other end of said flexible coupling shaft being fixed to the center of said casing, a support plate fixedly mounted on a foundation, and said flexible coupling being connected to said support plate, whereby said casing is prevented from being rotated by repulsive force caused by rotation of said body and is kept at rest during said rotation.

* * * * *